US007230345B2

(12) United States Patent
Winnie et al.

(10) Patent No.: US 7,230,345 B2
(45) Date of Patent: Jun. 12, 2007

(54) METHOD FOR EXERCISING A STAND-BY ELECTRICAL GENERATOR

(75) Inventors: Peter D. Winnie, Jefferson, WI (US); Francis X. Wedel, Lake Mills, WI (US); Robert D. Kern, Waukesha, WI (US); Alan P. Dietrich, Madison, WI (US); Douglas R. Clement, Wind Lake, WI (US)

(73) Assignee: Generac Power Systems, Inc., Waukesha, WI (US)

( * ) Notice: Subject to any disclaimer, the term of this patent is extended or adjusted under 35 U.S.C. 154(b) by 170 days.

(21) Appl. No.: 11/033,579

(22) Filed: Jan. 12, 2005

(65) Prior Publication Data

US 2006/0152198 A1 Jul. 13, 2006

(51) Int. Cl.
*F02N 11/06* (2006.01)

(52) U.S. Cl. ..... 290/40 D; 290/40 A; 290/40 B; 290/40 C

(58) Field of Classification Search ..... 290/1 A, 290/41, 40 A, 40 B, 40 C, 40 D; 322/7, 322/8, 14; 123/179.3, 339.17
See application file for complete search history.

(56) References Cited

U.S. PATENT DOCUMENTS 4,307,690 A * 12/1981 Rau et al. ..... 123/353
4,883,034 A * 11/1989 Yashiki et al. ..... 123/339.17
4,951,627 A * 8/1990 Watanabe et al. ..... 477/111
5,256,959 A * 10/1993 Nagano et al. ..... 322/25
5,320,077 A * 6/1994 Kamiya et al. ..... 123/339.11
5,504,417 A * 4/1996 Kern et al. ..... 322/32
5,539,258 A * 7/1996 Sutton et al. ..... 290/40 R
5,703,410 A * 12/1997 Maekawa ..... 290/40 C
5,973,481 A * 10/1999 Thompson et al. ..... 322/7
5,998,880 A * 12/1999 Kumar ..... 290/40 B
6,118,186 A * 9/2000 Scott et al. ..... 290/40 B
6,198,256 B1 * 3/2001 Miyazaki et al. ..... 322/16
6,624,528 B2 * 9/2003 Shimizu et al. ..... 290/40 C
6,657,416 B2 12/2003 Kern et al. ..... 322/29
6,740,986 B2 * 5/2004 Shimizu et al. ..... 290/40 C
6,840,203 B2 * 1/2005 Wakitani et al. ..... 123/179.3

* cited by examiner

*Primary Examiner*—Nicholas Ponomarenko
(74) *Attorney, Agent, or Firm*—Boyle Fredrickson Newholm Stein & Gratz S.C.

(57) ABSTRACT

A method is provided for exercising an engine-driven, electrical generator. The generator has a first operation mode wherein the generator generates a predetermined output voltage at a predetermined frequency with the engine running a predetermined operating speed and a second exercise mode. The method includes the step of running the engine at a predetermined exercise speed with the generator in the exercise mode. The predetermined exercise speed is in the range of 40% to 70% of the predetermined operating speed of the engine. In addition, in the exercise mode, the generator generates an exercise voltage that is less than the predetermined output voltage.

24 Claims, 2 Drawing Sheets

METHOD FOR EXERCISING A STAND-BY ELECTRICAL GENERATOR

FIELD OF THE INVENTION

This invention relates generally to engine-driven, electrical generators, and in particular, to a method for exercising a stand-by electrical generator to insure proper operation of the engine and the electrical generator driven therewith.

BACKGROUND AND SUMMARY OF THE INVENTION

Electrical generators are used in a wide variety of applications. Typically, an individual electrical generator operates in a stand-by mode wherein the electrical power provided by a utility is monitored such that if the commercial electrical power from the utility fails, the engine of the electrical generator is automatically started causing the alternator to generate electrical power. When the electrical power generated by the alternator reaches a predetermined voltage and frequency desired by the customer, a transfer switch transfers the load imposed by the customer from the commercial power lines to the electrical generator.

As is conventional, electrical generators utilize a single driving engine coupled to a generator or alternator through a common shaft. Upon actuation of the engine, the crankshaft rotates the common shaft so as to drive the alternator that, in turn, generates electrical power. Typically, prior electrical generators include radiators operatively connected to corresponding engines such that the engine coolant from the engines circulates through the radiators during operation of the engines. A fan, coupled to the crankshaft of the engine, rotates during operation of the electrical generator and draws air across the plurality of radiator tubes of the radiator so as to effectuate the heat exchange between the engine coolant flowing through the plurality of radiator tubes of the radiator and the air within the enclosure. In such a manner, it is intended that the air passing over the radiator tubes of the radiator having a cooling effect thereon so as to maintain the temperature of the engine coolant, and hence the temperature of the engine, below a safe operating limit.

As is known, engine-driven, electrical generators are often exercised to insure proper operation when their use is required. In order to exercise the engine-driven, electrical generator, the engine is either automatically or manually started and run for a predetermined time period at its full operating speed. It can be appreciated that any operation of the engine-driven, electrical generator can produce unwanted noise. The noise generated by the electrical generator during operation is often a result of the rotation of the fan used to cool the engine coolant flowing through the radiator tubes of the radiator of the electrical generator. Consequently, various attempts have been made to limit the time period and the speed at which the fan rotates during operation of the electrical generator to those situations wherein the engine coolant flowing through the radiator must be cooled. By way of example, a sensor may be provided to monitor the temperature of the engine coolant. The fan is operatively connected to the crankshaft of the engine only when the temperature of the engine coolant exceeds a predetermined threshold.

While these prior methods of minimizing the time period for rotating a fan of an engine-driven, electrical generator have been somewhat successful, each of these methods has significant limitations. By way of example, the use of a sensor and the associated electronics for selectively connecting the fan to the crankshaft of the engine can be cost prohibitive. Alternatively, by drawing air inward through the radiator as provided in various automotive applications, it has been found that the thermally responsive clutch interconnects the fan to the crankshaft at the engine for a longer period of time than is necessary to cool the engine coolant flowing through the radiator to a safe operating level. Hence, it can be appreciated that these prior art fan systems will generate more noise than necessary and/or desired by an end user.

Therefore, it is a primary object and feature of the present invention to provide a method for exercising a stand-by electrical generator that insures proper operation of the engine and the electrical generator driven therewith.

It is a further object and feature of the present invention to provide a method for exercising a stand-by electrical generator that generates less noise than prior methods.

It is a still further object and feature of the present invention to provide a method for exercising a stand-by electrical generator that is simple and that is less expensive than prior methods.

In accordance with the present invention, a method is provided for exercising an engine-driven, electrical generator. The generator generates a predetermined output voltage at a predetermined frequency with the engine running a predetermined operating speed. The method includes the steps of selecting a generator exercise mode for the generator and starting the engine. The engine is then run at a predetermined exercise speed that is less than the predetermined operating speed.

In addition, in the exercise mode, the generator generates an exercise voltage that is less than the predetermined output voltage of the generator with the generator in the generator exercise mode. It is contemplated for the exercise speed of the engine to be in the range of 40% to 70% of the predetermined operating speed of the engine. By way of example, when the predetermined operating speed is approximately 3600 revolutions per minute, the predetermined exercise speed is approximately 1800 revolutions per minute. When the predetermined operating speed is approximately 1600 revolutions per minute, the predetermined exercise speed is approximately 1200 revolutions per minute. When the predetermined operating speed is approximately 3000 revolutions per minute, the predetermined exercise speed is approximately 1500 revolutions per minute.

It is contemplated to provide a fuel mixture to the engine when the engine is running at the predetermined operating speed and reducing the fuel mixture provided to the engine with the generator in the generator exercise mode. Further, the output voltage of the generator is changed when the generator is in the generator exercise mode. A transfer switch may also be provided. The transfer switch has a first input connectable to a utility source, a second input operatively connected to the generator, and an output connectable to a load. The transfer switch is selectively movable between a first position connecting the utility source to the load and a second position connecting the generator to the load.

In accordance with a further aspect of the present invention, a method is provided for exercising an engine-driven, electrical generator. The generator generates a predetermined output voltage at a predetermined frequency with the engine running a predetermined operating speed. The method includes the steps of selecting a generator exercise mode for the generator and running the engine at a predetermined exercise speed. The predetermined exercise speed is in the range of 40% to 70% of the predetermined operating speed of the engine. By way of example, when the predetermined operating speed is approximately 3600 revolutions per minute, the predetermined exercise speed is approximately 1800 revolutions per minute. When the predetermined operating speed is approximately 1600 revolutions per minute, the predetermined exercise speed is approximately 1200 revolutions per minute. When the predetermined operating speed is approximately 3000 revolutions per minute, the predetermined exercise speed is approximately 1500 revolutions per minute.

It is contemplated to provide a fuel mixture to the engine when the engine is running at the predetermined operating speed and reducing the fuel mixture provided to the engine with the generator in the generator in the generator exercise mode. Further, the output voltage of the generator is changed when the generator in the generator exercise mode. A transfer switch may also be provided. The transfer switch has a first input connectable to a utility source, a second input operatively connected to the generator, and an output connectable to a load. The transfer switch is selectively movable between a first position connecting the utility source to the load and a second position connecting the generator to the load.

In accordance with a still further aspect of the present invention, a method is provided for exercising an engine-driven, electrical generator. The generator has a first operation mode wherein the generator generates a predetermined output voltage at a predetermined frequency with the engine running a predetermined operating speed and a second exercise mode. In the exercise mode, the engine runs at a predetermined exercise speed in the range of 40% to 70% of the predetermined operating speed of the engine. In addition, in the exercise mode, the generator generates an exercise voltage that less than the predetermined output voltage.

By way of example, when the predetermined operating speed is approximately 3600 revolutions per minute, the predetermined exercise speed is approximately 1800 revolutions per minute. When the predetermined operating speed is approximately 1600 revolutions per minute, the predetermined exercise speed is approximately 1200 revolutions per minute. When the predetermined operating speed is approximately 3000 revolutions per minute, the predetermined exercise speed is approximately 1500 revolutions per minute.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
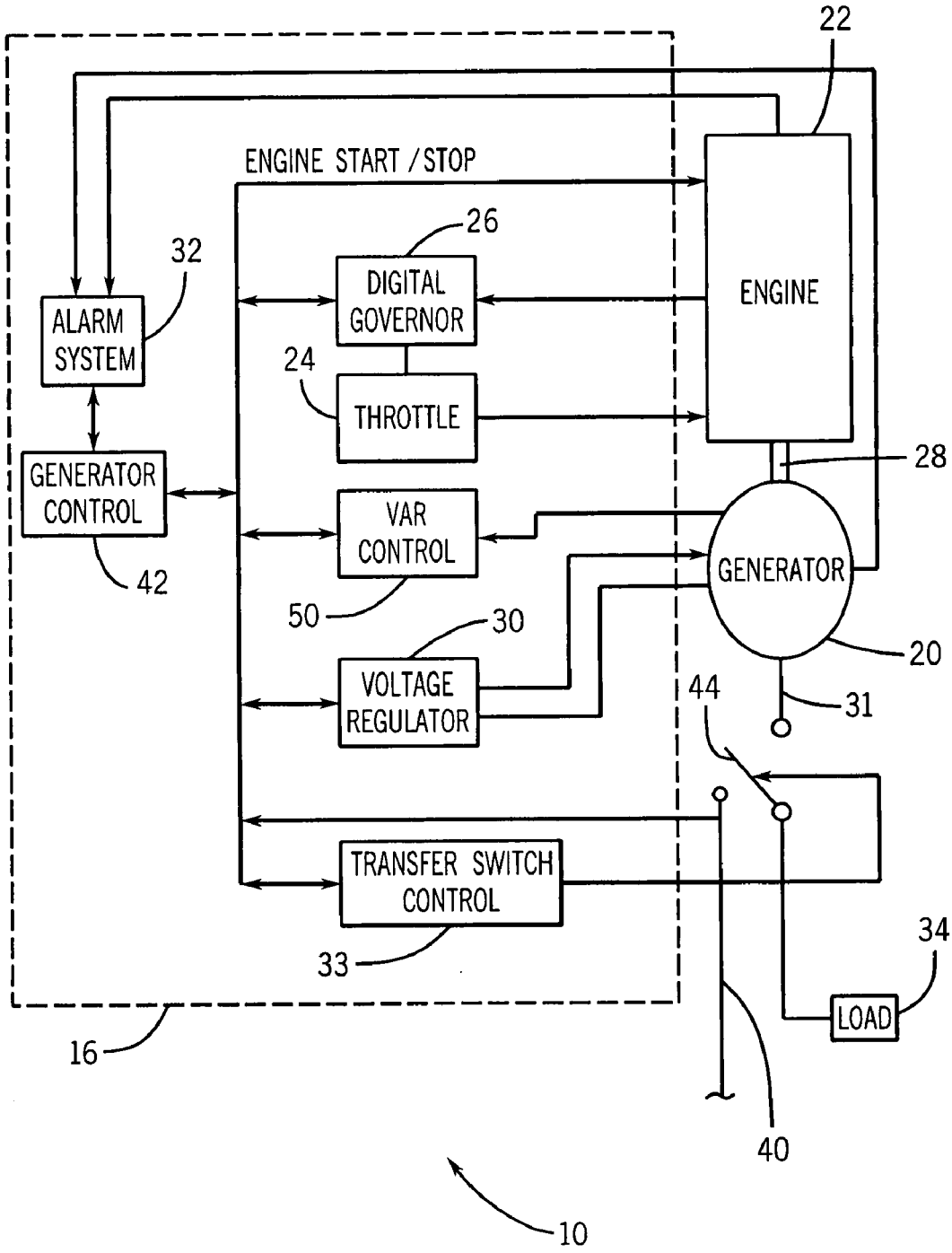
FIG. 1 is a schematic view of an engine-driven, electrical generator system for performing the method of the present invention.

Referring to FIG. 1, an engine-driven, electrical generator system for performing the method of the present invention is generally generated by the reference numeral 10. Generator system 10 includes generator panel 16 operatively connected to a corresponding generator 20, as hereinafter described. In addition, generator panel 16 is operatively connected to engine 22. As is conventional, engine 22 receives fuel such as natural gas or liquid propane vapor through an intake. The fuel provided to engine 22 is compressed and ignited within the cylinders thereof so as to generate reciprocating motion of the pistons of engine 22. The reciprocating motion of the pistons of engine 22 is converted to rotary motion by a crankshaft. The crankshaft is operatively coupled to generator 20 through shaft 28 such that as the crankshaft is rotated by operation of engine 22, shaft 28 drives generator 20 which, in turn, converts the mechanical energy generated by engine 22 to electrical power on output 31 of generator 20 for transmission and distribution.

Digital governor 26 is operatively connected to throttle 24 to control the volume of intake air to engine 22. As is known, digital governor 26 protects engine 22 from overspeed conditions and maintains engine 22 at a desired engine speed which, in turn, causes generator 20 to generate the desired electrical power at a desired frequency. Digital governor 26 controls the engine speed of engine 22 by regulating the position of throttle 24, and hence, the amount of fuel and air provided to the combustion chamber of engine 22. As is known, throttle 24 is movable between a wide-open position wherein engine 22 runs at full power and a closed position wherein engine 22 runs at minimum power. Generator control 42 controls operation of digital governor 26, and hence, throttle 24, as hereinafter described.

As is conventional, generator 20 generates AC voltage having a magnitude and a frequency and AC current having a magnitude and a frequency. In alternating current power transmission and distribution, the cosine of the phase angle (θ) between the AC voltage and the AC current is known as the power factor. The AC power generated by generator 20 may be calculated in according to the expression:

$$P = I \times V \times \cos\theta$$

wherein P is the AC power; I is the root means square of the AC current; and V is the root means square of the AC voltage.

The magnitude of the AC output voltage of generator 20 is monitored by voltage regulator 30. As is conventional, generator 20 includes an armature winding or exciter which controls the magnitude of the AC output voltage of generator 20. Voltage regulator 30 acts to increase or decrease the excitation of the exciter of generator 20 to the degree needed to maintain the magnitude of the AC output voltage at a desired value.

It is contemplated to operatively connect engine 22 and generator 20 to an alarm system 32. Alarm system 32 monitors various operating conditions of engine 22 and generator 20*a* and provides a warning if any of the operating conditions fall outside normal operating levels. In addition, alarm system 32 is operatively connected to generator control 42 such that generator control 42 may shut down generator 20 in response to certain, predetermined alarm conditions on engine 22 and/or generator 20 so as to prevent damage to generator system 10.

Generator 20 is operatively connectable to load 34 through transfer switch 44. Transfer switch 44 isolates the electrical power supplied by a utility on supply line 40 from the electrical power supplied at output 31 of generator 20. Electrical power supplied on supply line 40 is monitored such that if the electrical power from the utility fails, engine 22 is started by generator control 42, in a conventional manner. With engine 22 of generator system 10 started, generator 20 generates electrical power, as heretofore described. When the electrical power generated by generator 20 reaches the magnitude and frequency desired by the user, generator control 42 through transfer switch control 33 causes transfer switch 44 to transfer load 34 from supply line 40 to corresponding output 31 of generator 20. In response to restoration of electrical power on supply line 40 by the utility, generator control 42 through transfer switch controls 33 cause transfer switch 44 to transfer load 34 from output 31 of generator 20 to supply line 40. Thereafter, engine 22 is stopped by generator control 42 such that generator 20 no longer generates electrical power.

Figure 2:
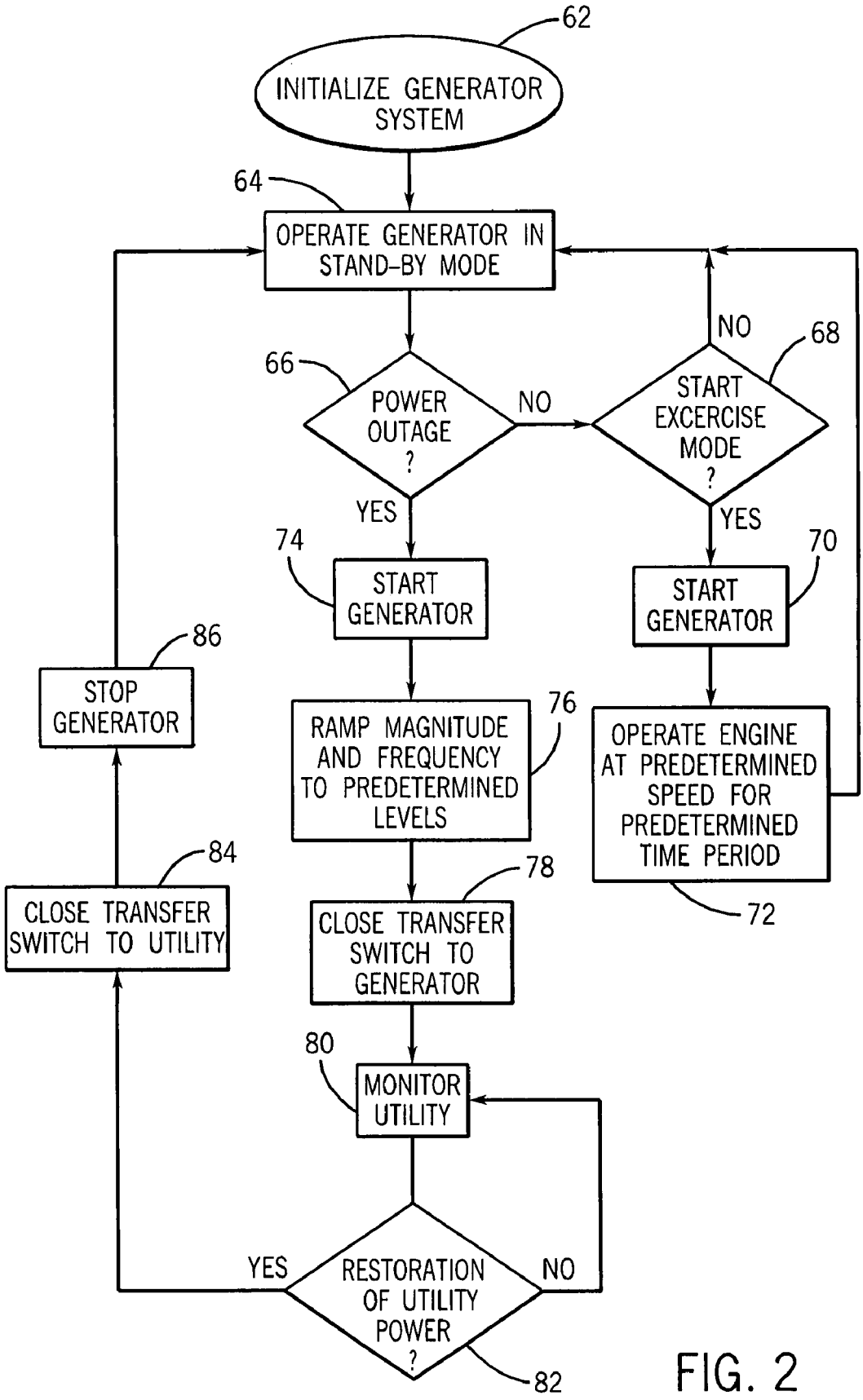
FIG. 2 is a flow chart depicting the method of the present invention.

Generator control 42 includes a microcontroller that executes a software program that effectuates the methodology of the present invention and which allows a user to monitor the electrical power supplied by generator 20; to monitor various operating conditions of engine 22 and of generator 20; and to control various operating parameters of generator system 10. Referring to FIG. 2, a flow chart of the methodology of the present invention is generally designated by the reference numeral 60.

Upon start up, generator system 10 including generator control 42 are initialized, block 62, and generator system 10 enters its stand-by mode, block 64, wherein generator control 42 monitors an electrical power supplied by a utility on supply line 40. In the stand-by mode, generator control 42 determines if the electrical power from the utility fails, block 66. In addition, generator control 42 determines if generator system 10 should enter its exercise mode, block 68. Generator system 10 may enter the exercise mode upon a manual command of a user, or automatically at predetermined times on predetermined dates.

In the event that generator system 10 does not enter its exercise mode, generator system 10 returns to its stand-by mode, block 64, and continues to monitor the electrical power supplied by the utility on supply line 40. In the event that generator system 10 does enter the exercise mode, either manually or auto-manually, engine 22 is started by generator control 42 such that generator 20 generates electrical power, block 70.

In its exercise mode, generator control 42 instructs digital governor 26 to maintain engine 22 at a predetermined exercise speed that falls in the range of 40% to 70% of the predetermined operating speed of the engine. Typically, the predetermined operating speed of engine 22 is approximately 3600 revolutions per minute. In the exercise mode, it is contemplated for the predetermined exercise speed to be approximately 1800 revolutions per minute. Alternatively, when the predetermined operating speed is approximately 1800 revolutions per minute, it is contemplated for the predetermined exercise speed to be approximately 1200 revolutions per minute. Finally, when the predetermined operating speed is approximately 3000 revolutions per minute, it is contemplated for the predetermined exercise speed to be approximately 1500 revolutions per minute. It can be appreciated that digital governor 24 controls the engine speed of engine 22 by regulating the position of throttle 24, and hence, the amount of fuel and air provided to the combustion engine of engine 22. In other words, the fuel mixture provided to engine 22 is reduced when the generator system 10 is in the exercise mode. As such, by operating the engine at a lower engine speed, the fan coupled to the crankshaft of engine 22 rotates at a corresponding slower speed. As a result, the noise generated by the fan of generator system 10 is less than the noise generated by the fan during operation of generator system 10 at the full operating speed of engine 22.

As heretofore described, the magnitude of the AC output voltage of generator 20 is monitored by voltage regulator 20. In the exercise mode, voltage regulator 30 acts to increase or decrease the excitation of exciter of generator 20 to the degree needed to maintain the magnitude of the AC output voltage at a desired value less than the output voltage with engine 22 operating at its full operating speed. Engine 22 is operated at its exercise speed for a predetermined time period, block 72, in order to insure proper operation of generator system 10. Thereafter, generator system 10 returns to its stand-by mode, block 64.

If the electrical power from the utility fails, block 66, generator control 42 of generator panel 16 starts engine 22 such that generator 20 generates electrical power, block 74, as heretofore described. The electrical power generated by generator 20 is ramped such that the magnitude and frequency of the electrical power reaches a predetermined level, block 76. Thereafter, transfer switch 44 transfers load 34 from supply line 40 to corresponding output 31 of generator 20, block 78. Generator control 42 continues to monitor the electrical power supplied on supply line 40, block 80. In response to restoration of electrical power on supply line 40 by the utility, block 82, generator control 42 of generator panel 16 causes transfer switch 44 to transfer load 34 from output 31 of generator 20 to the utility connected to supply line 40, block 84. Thereafter, generator control 42 stops engine 22 such that generator 20 no longer generates electrical power, block 86, and such that generator system 10 returns to its stand-by mode, block 64.

Various modes of carrying out the invention are contemplated as being within the scope of the following claims particularly pointing out and distinctly claiming the subject matter that is regarded as the invention.

We claim:

1. A method of exercising an engine-driven, electrical generator, the generator generating a predetermined output voltage at a predetermined frequency with the engine running a predetermined operating speed, the method comprising the steps of:

selecting a generator exercise mode for the generator;

starting the engine; and running the engine at a predetermined exercise speed, the exercise speed being less than the predetermined operating speed.

2. The method of claim 1 comprising the additional step of generating an exercise voltage with the generator that is less than the predetermined output voltage with the generator in the generator exercise mode.

3. The method of claim 1 wherein the exercise speed of the engine is in the range of 40% to 70% of the predetermined operating speed of the engine.

4. The method of claim 1 wherein the predetermined operating speed is approximately 3600 revolutions per minute and wherein the predetermined exercise speed is approximately 1800 revolutions per minute.

5. The method of claim 1 wherein the predetermined operating speed is approximately 1600 revolutions per minute and wherein the predetermined exercise speed is approximately 1200 revolutions per minute.

6. The method of claim 1 wherein the predetermined operating speed is approximately 3000 revolutions per minute and wherein the predetermined exercise speed is approximately 1500 revolutions per minute.

7. The method of claim 1 wherein the engine includes the additional steps of providing a fuel mixture to the engine when the engine is running at the predetermined operating speed and reducing the fuel mixture providing to the engine with the generator in the generator in the generator exercise mode.

8. The method of claim 1 comprising the additional steps of changing the output voltage of the generator with the generator in the generator exercise mode.

9. The method of claim 1 wherein the step of selecting a generator exercise mode for the generator includes additional step of manually starting the engine.

10. The method of claim 1 comprising the additional step of providing a transfer switch having a first input connectable to a utility source, a second input operatively connected to the generator, and an output connectable to a load, the transfer switch is selectively movable between a first position connecting the utility source to the load and a second position connecting the generator to the load.

11. A method of exercising an engine-driven, electrical generator, the generator generating a predetermined output voltage at a predetermined frequency with the engine running a predetermined operating speed, the method comprising the steps of:

selecting a generator exercise mode for the generator; and running the engine at a predetermined exercise speed, the predetermined exercise speed in the range of 40% to 70% of the predetermined operating speed of the engine.

12. The method of claim 11 comprising the additional step of generating an exercise voltage with the generator in the generator exercise mode, the exercise voltage being less than the predetermined output voltage.

13. The method of claim 11 wherein the predetermined operating speed is approximately 3600 revolutions per minute and wherein the predetermined exercise speed is approximately 1800 revolutions per minute.

14. The method of claim 11 wherein the predetermined operating speed is approximately 1800 revolutions per minute and wherein the predetermined exercise speed is approximately 1200 revolutions per minute.

15. The method of claim 11 wherein the predetermined operating speed is approximately 3000 revolutions per minute and wherein the predetermined exercise speed is approximately 1500 revolutions per minute.

16. The method of claim 11 wherein the engine includes the additional steps of providing a fuel mixture to the engine when the engine is running at the predetermined operating speed and reducing the fuel mixture providing to the engine with the generator in the generator in the generator exercise mode.

17. The method of claim 11 comprising the additional steps of changing the output voltage of the generator with the generator in the generator exercise mode.

18. The method of claim 11 further comprising the additional step of manually starting the engine.

19. The method of claim 11 comprising the additional step of providing a transfer switch having a first input connectable to a utility source, a second input operatively connected to the generator, and an output connectable to a load, the transfer switch is selectively movable between a first position connecting the utility source to the load and a second position connecting the generator to the load.

20. A method of exercising an engine-driven, electrical generator, the generator having a first operation mode wherein the generator generates a predetermined output voltage at a predetermined frequency with the engine running a predetermined operating speed and a second exercise mode, the method comprising the steps of:

running the engine at a predetermined exercise speed with the generator in the exericise mode, the predetermined exercise speed in the range of 40% to 70% of the predetermined operating speed of the engine; and generating an exercise voltage with the generator in the generator exercise mode, the exercise voltage being less than the predetermined output voltage.

21. The method of claim 20 wherein the predetermined operating speed is approximately 3600 revolutions per minute and wherein the predetermined exercise speed is approximately 1800 revolutions per minute.

22. The method of claim 21 wherein the predetermined operating speed is approximately 1600 revolutions per minute and wherein the predetermined exercise speed is approximately 1200 revolutions per minute.

23. The method of claim 21 wherein the predetermined operating speed is approximately 3000 revolutions per minute and wherein the predetermined exercise speed is approximately 1500 revolutions per minute.

24. The method of claim 20 comprising additional steps of providing a first volume of fuel to the engine when the generator in the operating mode and providing a second volume of fuel to the engine with the generator in the exercise mode, the second volume of fuel being less than the first volume of fuel.

* * * * *

US007230345C1

(12) EX PARTE REEXAMINATION CERTIFICATE (8667th)

United States Patent
Winnie et al.

(10) Number: US 7,230,345 C1
(45) Certificate Issued: Nov. 15, 2011

(54) METHOD FOR EXERCISING A STAND-BY ELECTRICAL GENERATOR

(75) Inventors: Peter D. Winnie, Jefferson, WI (US); Francis X. Wedel, Lake Mills, WI (US); Robert D. Kern, Waukesha, WI (US); Alan P. Dietrich, Madison, WI (US); Douglas R. Clement, Wind Lake, WI (US)

(73) Assignee: Goldman Sachs Credit Partners L.P., Jersey City, NJ (US)

Reexamination Request:
No. 90/011,403, Dec. 23, 2010

Reexamination Certificate for:

| | |
|---|---|
| Patent No.: | **7,230,345** |
| Issued: | **Jun. 12, 2007** |
| Appl. No.: | **11/033,579** |
| Filed: | **Jan. 12, 2005** |

(51) Int. Cl.
*F02N 11/06* (2006.01)

(52) U.S. Cl. ..... 290/40 D; 290/40 A; 290/40 B; 290/40 C

(58) Field of Classification Search ..... 290/40 D
See application file for complete search history.

(56) References Cited

To view the complete listing of prior art documents cited during the proceeding for Reexamination Control Number 90/011,403, please refer to the USPTO's public Patent Application Information Retrieval (PAIR) system under the Display References tab.

*Primary Examiner*—Albert J Gagliardi

(57) ABSTRACT

A method is provided for exercising an engine-driven, electrical generator. The generator has a first operation mode wherein the generator generates a predetermined output voltage at a predetermined frequency with the engine running a predetermined operating speed and a second exercise mode. The method includes the step of running the engine at a predetermined exercise speed with the generator in the exercise mode. The predetermined exercise speed is in the range of 40% to 70% of the predetermined operating speed of the engine. In addition, in the exercise mode, the generator generates an exercise voltage that is less than the predetermined output voltage.

At the time of issuance and publication of this certificate, the patent remains subject to pending reexamination control No. 95/001,558 filed May 16, 2011. The claim content of the patent may be subsequently revised if a reexamination certificate issues from the reexamination proceeding.

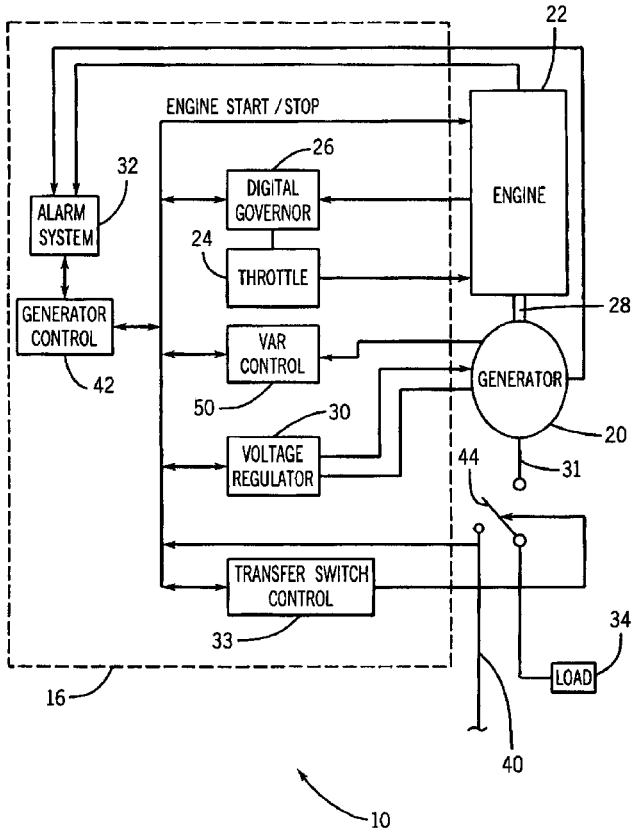

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-24 is confirmed.

* * * * *